US007862312B2

(12) United States Patent
Gopinathan

(10) Patent No.: US 7,862,312 B2
(45) Date of Patent: Jan. 4, 2011

(54) SUCTION BAFFLE FOR SCROLL COMPRESSORS

(75) Inventor: Anil Gopinathan, Clinton, MI (US)

(73) Assignee: Tecumseh Products Company, Ann Arbor, MI (US)

( * ) Notice: Subject to any disclaimer, the term of this patent is extended or adjusted under 35 U.S.C. 154(b) by 324 days.

(21) Appl. No.: 11/679,337

(22) Filed: Feb. 27, 2007

(65) Prior Publication Data

US 2007/0183914 A1 Aug. 9, 2007

Related U.S. Application Data

(63) Continuation-in-part of application No. 11/120,127, filed on May 2, 2005, now abandoned.

(51) Int. Cl.
*F01C 1/02* (2006.01)

(52) U.S. Cl. ..... 418/55.1; 418/55.2

(58) Field of Classification Search ..... None
See application file for complete search history.

(56) References Cited

U.S. PATENT DOCUMENTS 4,332,535 A 6/1982 Terauchi et al.
4,538,975 A 9/1985 Tsukagoshi
4,623,306 A 11/1986 Nakamura et al.
4,730,998 A * 3/1988 Kakuda et al. ..... 418/55.1
4,767,293 A 8/1988 Caillat et al.
4,877,382 A * 10/1989 Caillat et al. ..... 418/55.5
4,895,496 A * 1/1990 Elson ..... 417/372
4,934,910 A * 6/1990 Utter ..... 418/55.4
4,992,033 A 2/1991 Caillat et al.
4,998,864 A * 3/1991 Muir ..... 417/410.5
5,037,278 A 8/1991 Fujio et al.
5,055,010 A * 10/1991 Logan ..... 417/410.5
5,114,322 A 5/1992 Caillat et al.
5,219,281 A 6/1993 Caillat et al.
5,240,391 A * 8/1993 Ramshankar et al. .... 417/410.1
5,366,352 A * 11/1994 Deblois et al. ..... 417/292
5,380,170 A * 1/1995 Fain ..... 417/410.5
5,427,511 A 6/1995 Caillat et al.
5,482,450 A 1/1996 Caillat et al.
5,683,237 A * 11/1997 Hagiwara et al. ..... 418/55.2
5,741,120 A * 4/1998 Bass et al. ..... 417/44.2
5,772,416 A 6/1998 Caillat et al.
5,931,649 A 8/1999 Caillat et al.
6,000,917 A * 12/1999 Smerud et al. ..... 417/368

(Continued)

*Primary Examiner*—Thomas Denion
*Assistant Examiner*—Douglas J. Duff
(74) *Attorney, Agent, or Firm*—Baker & Daniels LLP

(57) ABSTRACT

A scroll compressor including a hermetic housing with a motor-compressor unit disposed therein, including fixed and orbiting scrolls. The fixed scroll defines perpendicular axial and radial directions, and includes an outer wall having a suction inlet facing substantially in the radial direction. A baffle member is associated with the suction inlet of the fixed scroll, and in one embodiment, is attached to the fixed scroll with fasteners. The baffle member includes a first open end facing in the axial direction toward a suction port of the compressor housing, and a second open end facing in the radial direction in fluid flow alignment with the suction inlet of the fixed scroll. The baffle member directs a portion of the working fluid which enters the compressor housing substantially directly into the suction inlet of the fixed scroll to reduce turbulent flow of the working fluid within the compressor housing, improving the operating efficiency of the compressor.

23 Claims, 6 Drawing Sheets

U.S. PATENT DOCUMENTS 6,017,205 A * 1/2000 Weatherston et al. ..... 418/55.6
6,086,335 A * 7/2000 Bass et al. ..... 417/220
6,315,536 B1 11/2001 DeVore et al.
6,402,485 B2 * 6/2002 Hong et al. ..... 417/366
6,474,964 B2 * 11/2002 De Bernardi et al. ..... 418/55.6
6,807,821 B2 * 10/2004 Narney, II ..... 62/324.6
7,018,184 B2 3/2006 Skinner et al.
7,311,501 B2 * 12/2007 Wehrenberg et al. ..... 417/371
2004/0047754 A1 3/2004 Gopinathan
2006/0245967 A1 11/2006 Gopinathan

* cited by examiner

SUCTION BAFFLE FOR SCROLL COMPRESSORS

CROSS REFERENCE TO RELATED APPLICATIONS

This application is a continuation-in-part of U.S. patent application Ser. No. 11/120,127, entitled SUCTION BAFFLE FOR SCROLL COMPRESSORS, filed on May 2, 2005, the disclosure of which is expressly incorporated by reference herein.

BACKGROUND OF THE INVENTION

1. Field of the Invention

The present invention relates to scroll machines, and in particular, to the manner in which a working fluid is drawn into the variable volume working pockets which are defined between the fixed and orbiting scrolls of a scroll compressor.

2. Description of the Related Art

Referring to FIG. 1, a scroll compressor 10 is shown, which includes main housing 12, bottom cap 14 with base 16 secured to the lower end of housing 12, and a separator plate 18 and top cap 20 each secured to the upper end of housing 12 by a welding, brazing, or other suitable operation to define an enclosed hermetic housing in which the motor-compressor unit 22 of compressor 10 is disposed. Motor-compressor unit 22 generally includes a first, fixed scroll 24, a second, orbiting scroll 26, crankcase 28, drive shaft 30, stator 32, rotor 34, and outboard bearing assembly 36. Separator plate 18 is secured around its perimeter to the interior of housing 12, such as by welding, and divides the interior of the housing 12 into a suction chamber 38 in fluid communication with suction port 40 in housing 12, and discharge chamber 42 in fluid communication with discharge port 44 in top cap 20.

Fixed scroll 24 is secured to separator plate 18, such as by a plurality of bolts, and includes outer wall 46 extending from base plate 48, and an involute wrap 50 extending from base plate 48 and disposed inwardly of outer wall 46. Fixed scroll 24 further includes a plurality of mount flanges 52 spaced radially about the end of outer wall 46 opposite base plate 48, and a plurality of bolts secure mount flanges 52 to crankcase 28. Crankcase 28 includes main bearing 54 in which the upper portion of drive shaft 30 is rotatably supported. Stator 32 is fixed within housing 12 by a plurality of bolts (not shown) which pass through outboard bearing assembly 36, stator 32, and into crankcase 28. Drive shaft 30 is secured to rotor 34 in a suitable manner, and outboard bearing assembly 36 includes outboard bearing 56 which supports a lower end of drive shaft 30. The upper portion of drive shaft 30 includes an eccentric end mounted within annular hub 58 extending downwardly from base plate 60 of orbiting scroll 26. Orbiting scroll 26 additionally includes an involute wrap 62 extending upwardly from base plate 60 thereof, which is in meshing relationship with wrap 50 of fixed scroll 24. Oldham coupling 64 is operatively coupled between orbiting scroll 26 and crankcase 28 to prevent rotation of orbiting scroll 24, as is known.

In operation, electrical energization of stator 32 rotatably drives rotor 34 and drive shaft 30 to move orbiting scroll 26 in an orbiting manner with respect to fixed scroll 24. A working fluid at suction pressure is drawn from suction chamber 38 into a suction inlet 66 of fixed scroll 24, and is compressed within the plurality of variable volume, working pockets which are defined between wraps 50 and 62 of fixed and orbiting scrolls 24 and 26, respectively, as orbiting scroll 26 rotates in a known manner. The compressed working fluid is then discharged through discharge outlet 68 in base plate 48 of fixed scroll 24, through discharge check valve assembly 70, and into discharge chamber 42 at a discharge pressure.

More specifically, working fluid at suction pressure enters suction chamber 38 via suction port 40 and initially impinges upon crankcase 28. Thereafter, a portion of the working fluid flows downwardly within suction chamber 38, as designated by arrow A in FIG. 1, and another portion of the working fluid flows upwardly within suction chamber 38, as designated by arrow B in FIG. 1. Problematically, the portion of the working fluid which flows upwardly within suction chamber 38 along arrow B contacts housing 12, separator plate 18, and outer wall 46 of fixed scroll, which tends induces a spiraling, turbulent flow of the working fluid in the upper portion of suction chamber 38, illustrated by arrows C in FIG. 1, before the working fluid is eventually drawn into suction inlet 66 of fixed scroll 24.

The turbulent flow of the working fluid within the upper portion of suction chamber 38 can potentially adversely effect the operating efficiency of compressor 10 by inhibiting uniform suction of working fluid into the suction inlet of the scrolls. Additionally, the working fluid also tends to become heated, for example by the discharge gas above separator plate 18, if the working fluid circulates within the upper portion of the suction chamber before entering the suction inlet of the scrolls, which can also reduce the efficiency of the compressor.

It is known to mount a baffle in a scroll compressor to the inner surface of the compressor housing over the suction inlet port. Problematically, however, these types of baffles are difficult to assemble after the motor compressor unit is installed within the compressor housing, and alternatively, when these types of baffles are attached to the interior of the compressor housing prior to installation of the motor compressor unit, same can impede mounting of the motor compressor unit within the compressor housing. Also, the connection between the baffle and the compressor housing may not be substantially rigid, and suction gas may be allowed to escape into the suction chamber as same travels between the suction baffle and the inlet of the scrolls.

What is needed is a scroll compressor which is an improvement over the foregoing.

SUMMARY OF THE INVENTION

The present invention provides a scroll compressor including a hermetic housing with a motor-compressor unit disposed therein, including fixed and orbiting scrolls. The fixed scroll defines perpendicular axial and radial directions, and includes an outer wall having a suction inlet facing substantially in the radial direction. A baffle member is associated with the suction inlet of the fixed scroll, and in one embodiment, is attached to the fixed scroll with fasteners. The baffle member includes a first open end facing in the axial direction toward a suction port of the compressor housing, and a second open end facing in the radial direction in fluid flow alignment with the suction inlet of the fixed scroll. The baffle member directs a portion of the working fluid which enters the compressor housing substantially directly into the suction inlet of the fixed scroll to reduce turbulent flow of the working fluid within the compressor housing, improving the operating efficiency of the compressor.

In one form thereof, the present invention provides a compressor, including a housing having a suction port; a motor-compressor unit disposed within the housing, including a crankcase and a stator, rotor, and drive shaft assembly, the drive shaft rotatably supported by the crankcase, the crankcase including a wall directly facing, and in fluid communication with, the suction port; a first scroll member fixed with respect to the housing and defining perpendicular axial and radial directions, the first scroll member including a base plate; a first wrap extending from the base plate; and an outer wall having a suction inlet facing substantially in the radial direction, the suction inlet including a baffle member; and a second scroll member coupled to the drive shaft for orbital movement, the second scroll member including a second wrap intermeshed with the first wrap.

In another form thereof, the present invention provides a compressor, including a housing having a suction port and a discharge port; a motor-compressor unit disposed within the housing, including a crankcase and a stator, rotor, and drive shaft assembly, the drive shaft rotatably supported by the crankcase; a first scroll member fixed with respect to the housing and defining perpendicular axial and radial directions and having a lower end with respect to the axial direction, the first scroll member including a base plate; a first wrap extending from the base plate; an outer wall having a suction inlet facing substantially in the radial direction; and a baffle member attached to the fixed scroll and including an open end facing substantially in the axial direction toward the suction port, the baffle member having a lower end which does not extend beyond the lower end of the base plate of the first scroll member; and a second scroll member coupled to the drive shaft for orbital movement, the second scroll member including a second wrap intermeshed with the first wrap.

In a further form thereof, the present invention provides a compressor, including a housing having a suction port and a discharge port; a motor-compressor unit disposed within the housing and operable to receive a working fluid at a suction pressure from the suction port, compress the working fluid, and discharge the working fluid at a discharge pressure through the discharge port, the motor-compressor unit including a crankcase including at least one wall directly facing the suction port such that working fluid entering the suction port impinges directly on the crankcase wall; a stator, rotor, and drive shaft assembly, the drive shaft rotatably supported by the crankcase; a first scroll member fixed with respect to the housing and defining perpendicular axial and radial directions, the first scroll member including a base plate, a first wrap extending from the base plate, and an outer wall having a suction inlet facing substantially in the radial direction; a second scroll member coupled to the drive shaft for orbital movement, the second scroll member including a second wrap intermeshed with the first wrap; a baffle member attached to the first scroll and including a first end facing substantially in the axial direction toward the suction port and a second end facing substantially in the radial direction toward the suction inlet, whereby at least a portion of the working fluid which enters the suction port and impinges directly on the crankcase wall is directed by the baffle member into the suction inlet.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention any manner.

DETAILED DESCRIPTION

Figure 1:
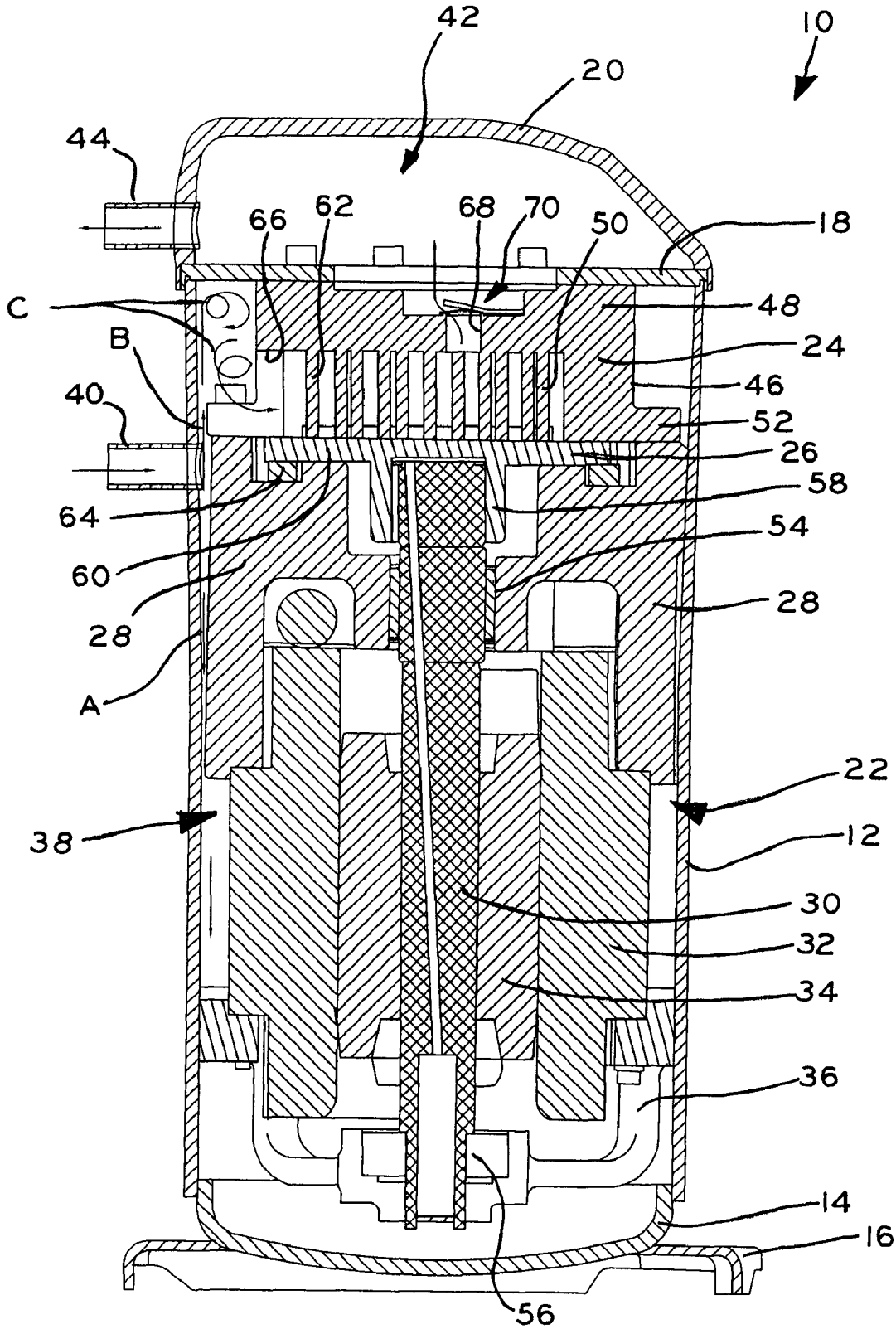
FIG. 1 PRIOR ART
FIG. 1 is a vertical sectional view through a known scroll compressor, illustrating the flow of working fluid within the suction chamber of the compressor.
Figure 2:
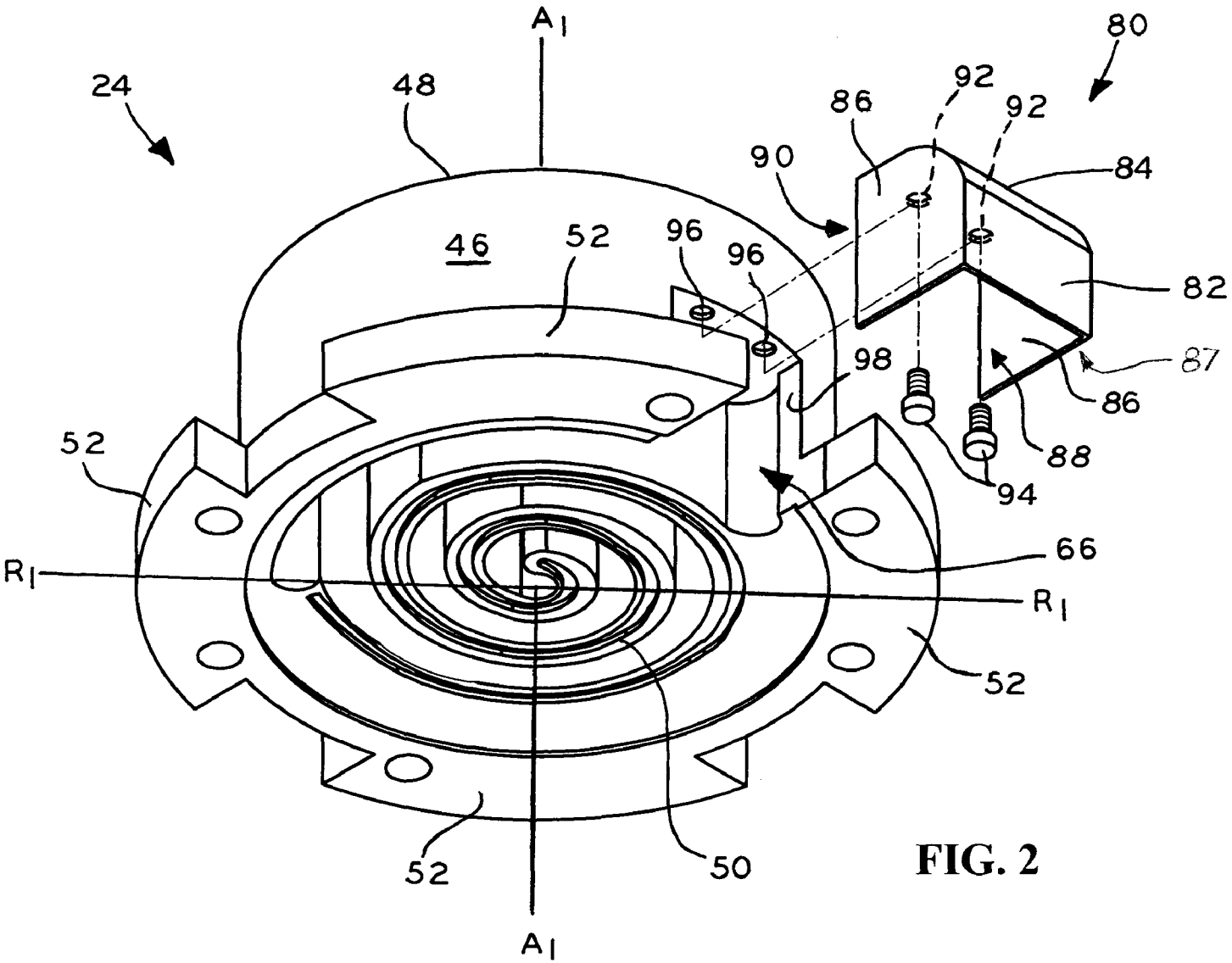
FIG. 2 is a first perspective exploded view showing a fixed scroll and a baffle member according to the present invention.
Figure 3:
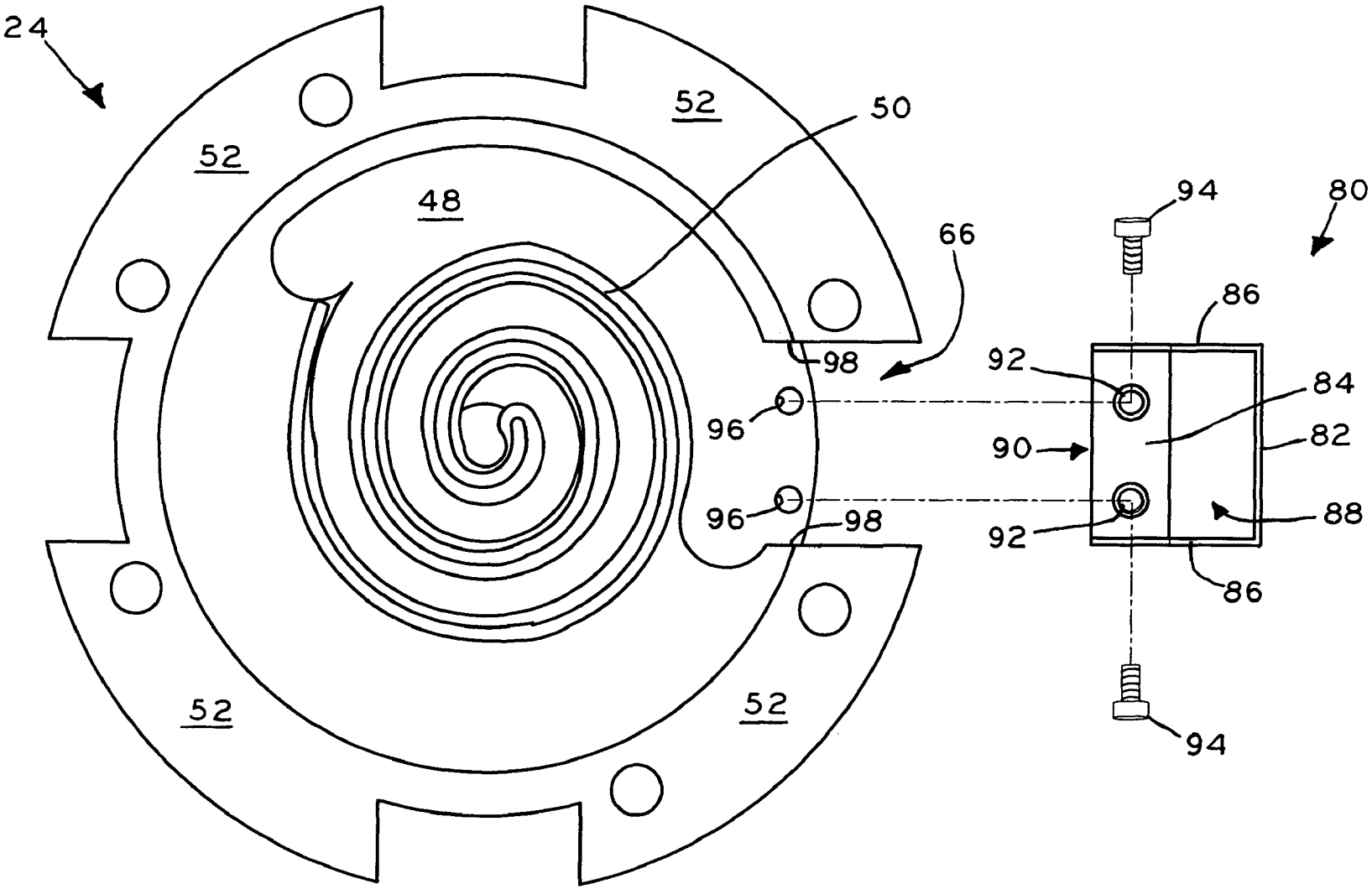
FIG. 3 is a second perspective exploded view of the fixed scroll and the baffle member of FIG. 2.
Figure 4:
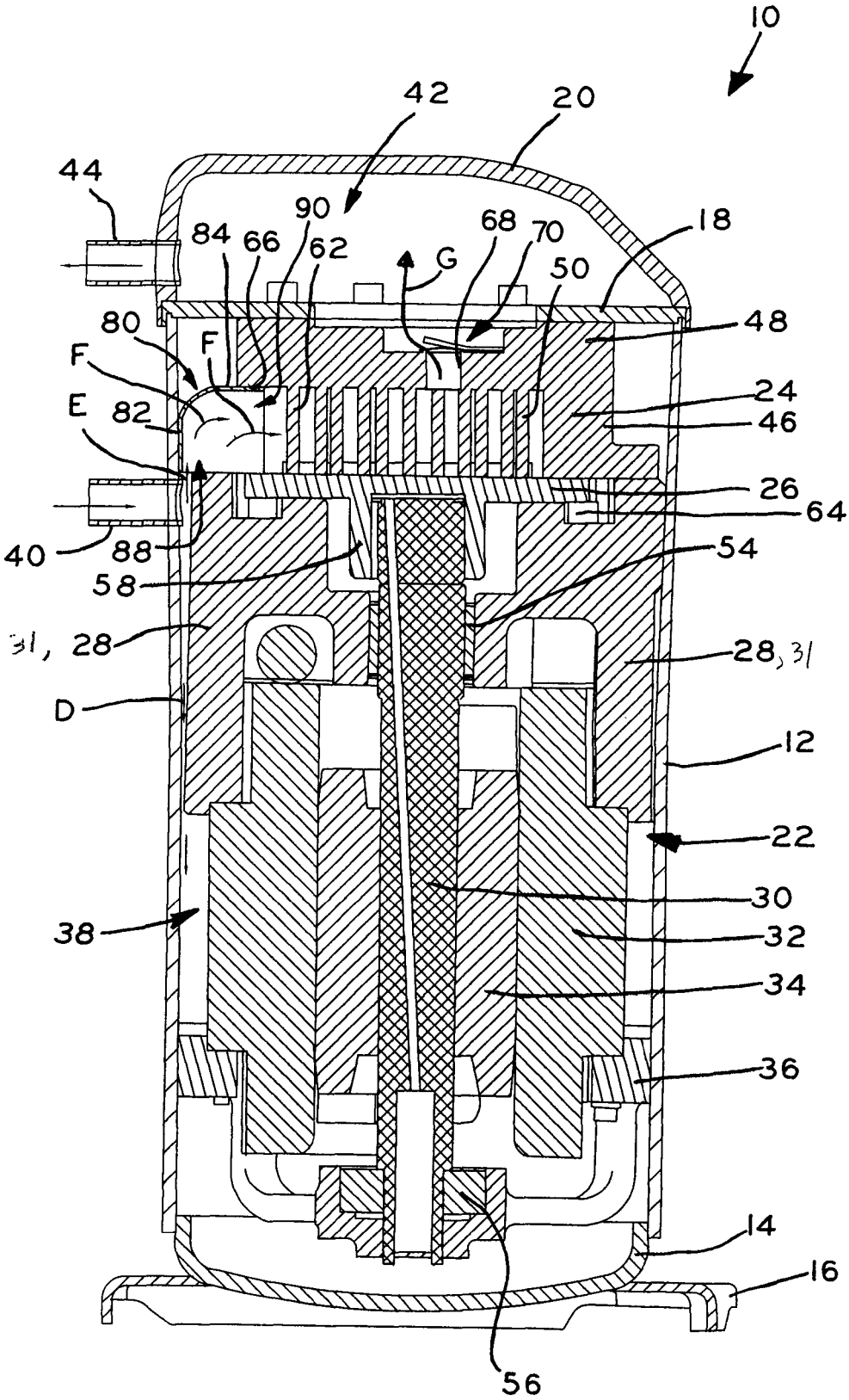
FIG. 4 is a vertical sectional view through the scroll compressor of FIG. 1, showing the fixed scroll and the baffle member of FIGS. 2 and 3, and illustrating the manner in which the baffle member directs working fluid into the suction inlet of the fixed scroll.

Referring to FIGS. 2-4, baffle member 80 according to the present invention is shown, which is associated with suction inlet 66 of fixed scroll 24 of scroll compressor 10. Except as described below, the components of scroll compressor 10 which are shown in FIGS. 2-4 are substantially identical to the components of scroll compressor 10 which are shown in FIG. 1, and the same reference numerals will be used to indicate identical or substantially identical components therebetween. Although scroll compressor 10 is shown disposed vertically in FIG. 4, baffle member 80 of the present invention is equally applicable in scroll compressors which are disposed horizontally or in other orientations. Further details regarding scroll compressor 10 are disclosed in U.S. Patent Application Publication No. 2004/0047754, assigned to the assignee of the present invention, the disclosure of which is expressly incorporated herein by reference.

Referring to FIG. 2, fixed scroll 24 defines perpendicular radial and axial directions. The radial direction is generally aligned along a line such as $R_1$-$R_1$ of FIG. 2 which, with reference to FIG. 4, is substantially perpendicular to the long axis of scroll compressor 10. The axial direction is generally aligned along line $A_1$-$A_1$ of FIG. 2 which, with reference to FIG. 4, is substantially parallel to the long axis of scroll compressor 10.

Referring to FIGS. 2 and 3, baffle member 80 includes front wall 82, curved top wall 84, and a pair of opposing side walls 86. Front wall 82 and side walls 86 together define a first open end 88 of baffle member 80 which, as shown in FIGS. 2-4, faces in the axial direction toward suction port 40 of scroll compressor 10 when baffle member 80 is secured to fixed scroll 24 in the manner described below. Top wall 84 and side walls 86 together define a second opening 90 of baffle member 80 which, as shown in FIGS. 2-4, faces in the radial direction toward suction inlet 66 of fixed scroll 24 when baffle member 80 is secured to fixed scroll 24 in the manner described below.

Baffle member 80 may be made from metal, such as from stamped or formed sheet steel, or from cast materials. Alternatively, baffle member 80 may be made of a suitable substantially rigid plastic material, such as polyethylene, polystyrene, polypropylene, ABS, or polyether ether ketone ("PEEK") by injection molding, for example. When baffle member 80 is made of a substantially non-heat conducting plastic material, baffle member 80 advantageously insulates the working fluid which passes through baffle member 80 from becoming heated by heat from the scrolls or from the discharge chamber 42, thereby increasing the operating efficiency of compressor 10.

Top wall 84 of baffle member 80 includes a pair of apertures 92 through which fasteners 94 are inserted. Fasteners 94 in turn threadably engage respective holes 96 in base plate 48 of fixed scroll 24 to secure baffle member 80 to fixed scroll 24 with top wall 84 of baffle member 80 in abutment with base plate 48 of fixed scroll 24 and side walls 86 of baffle member 80 in abutment with sides 98 of outer wall 46 of fixed scroll 24.

Alternatively, baffle member 80 may be secured to base plate 48 of fixed scroll 24 by other fasteners such as rivets, for example, or may be secured to base plate 48 of fixed scroll 24 in a fastenerless manner, such as by welding or brazing. Each of these attachment methods advantageously rigidly secures baffle member 80 to base plate 48 of fixed scroll 24 to prevent baffle member 80 from generating vibrational sound during operation of the compressor. Baffle member 80 also may be secured to outer wall 46 of fixed scroll 24, such as by welding, brazing, or with suitable fasteners. Further, baffle member 80 may be formed integrally with fixed scroll 24.

As may be seen in FIGS. 2 and 4, walls 82 and 86 of baffle member 80 define a lower end 87 of baffle member 80 and top wall 84 of baffle member 80 defines an upper end of baffle member 80 which, when baffle member 80 is attached to fixed scroll 24, may not extend downwardly or upwardly beyond lowermost and uppermost ends of fixed scroll 24, respectively. The lowermost end of fixed scroll 24 is defined by the tips of fixed scroll wrap 50 and/or the lowermost ends of mount flanges 52 of fixed scroll 24, and the uppermost end of fixed scroll 24 is defined by the axial upper surface of base plate 48 of fixed scroll 24. The lower and upper ends of baffle member 80 and fixed scroll 24 are defined with respect to the axial direction of compressor 10 and fixed scroll 24 and, alternatively stated, are the ends of baffle member 80 and fixed scroll 24 that are disposed most closely toward or away from crankcase 28 and the lower end of compressor 10, respectively. In this manner, baffle member 80 does not project beyond the lowermost or uppermost ends of fixed scroll 24, thereby reducing the potential for baffle member 80 to be bent or otherwise damaged by inadvertent contact during handling of fixed scroll 24 after attachment of baffle member 80 to fixed scroll 24 and prior to mounting fixed scroll 24 within compressor 10.

Alternatively, the lowermost end of baffle member 80 may, in other embodiments, extend downwardly beyond the lowermost end of fixed scroll 24. As shown in FIG. 4, the upper end of baffle member 80, defined by wall 84 thereof, is disposed at substantially the same axial level with respect to the location at which wrap 50 is joined to base plate 48 of fixed scroll 24. However, depending on the axial height of the wrap 50 of fixed scroll 24, the upper end of baffle member 80 may be positioned either above or below the end of wrap 50 which is joined to base plate 48 of fixed scroll 24.

With reference to FIGS. 2-4, when baffle member 80 is mounted to fixed scroll 24 in association with suction inlet 66 of fixed scroll 24 in the manner described above, first open end 88 of baffle member 80 faces in the axial direction toward suction port 40 of compressor 10, and is disposed generally proximate suction port 40 yet spaced slightly away therefrom in the axial direction. Also, when baffle member 80 is mounted to fixed scroll 24 in association with suction inlet 66 of fixed scroll 24 in the manner described above, second open end 90 of baffle member 80 faces in the radial direction, and is in fluid flow alignment with suction inlet 66 of fixed scroll 24.

Figure 5:
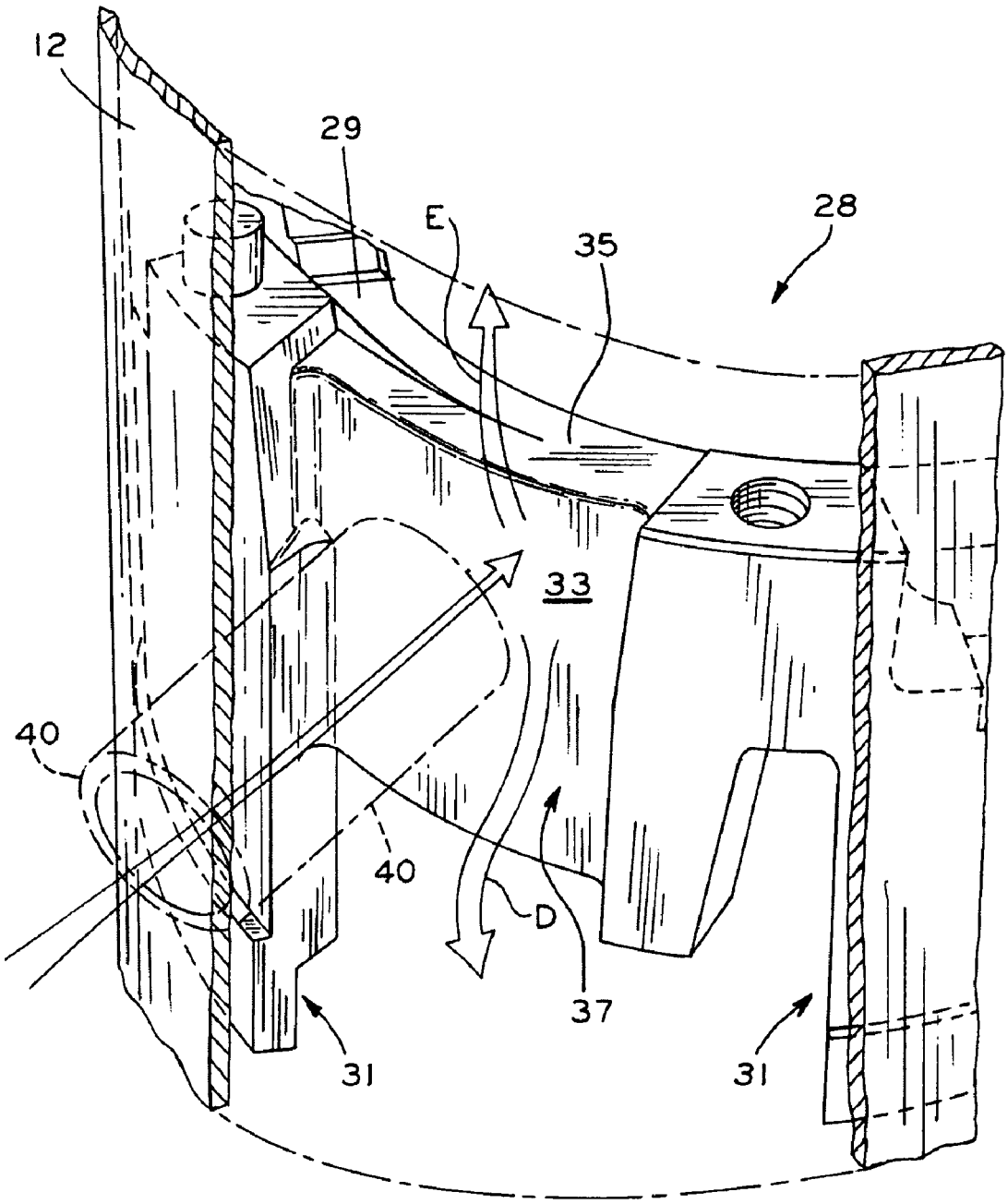
FIG. 5 is a fragmentary view of a portion of the crankcase, showing the suction port in phantom.
Figure 6:
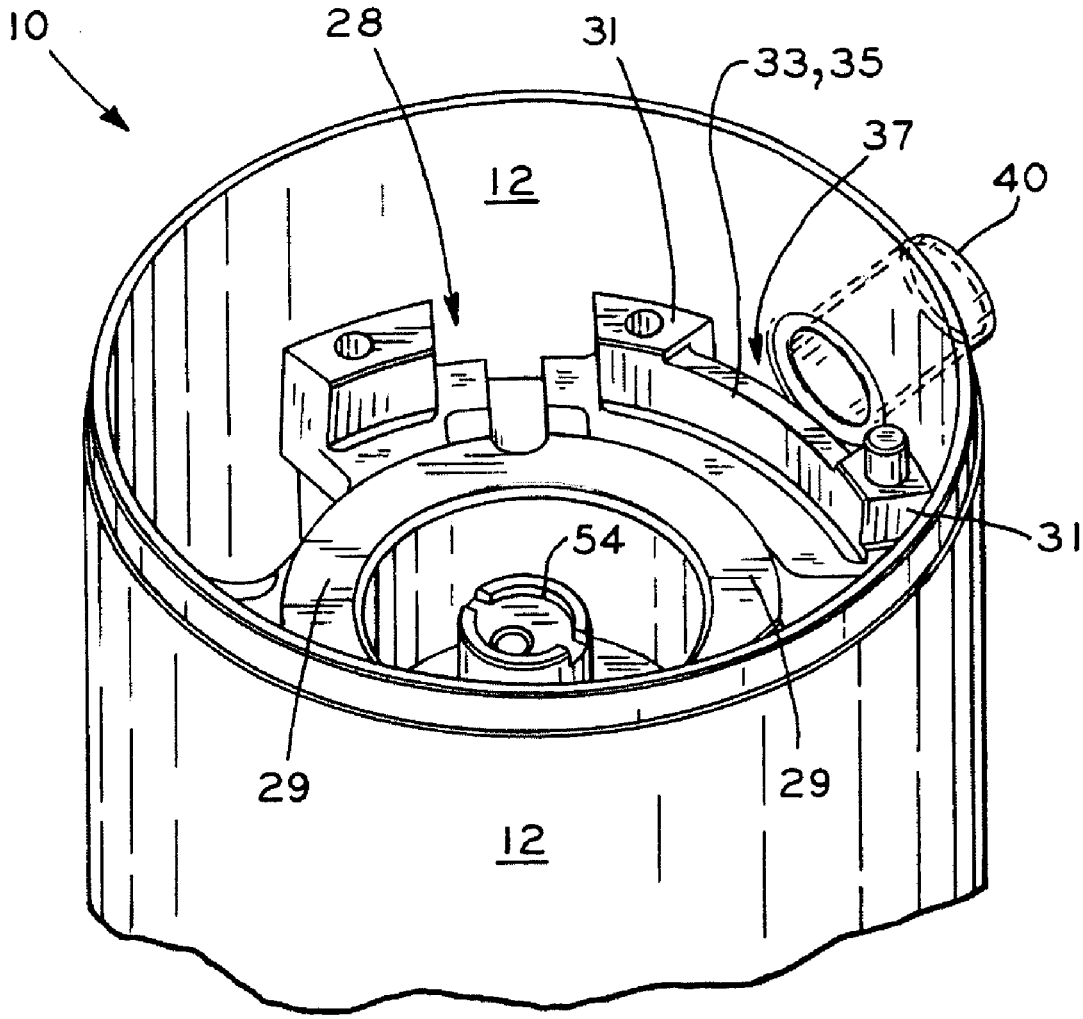
FIG. 6 is a fragmentary perspective view of the upper portion of the compressor shown without the top cap and scroll members.

As shown in FIGS. 5 and 6, crankcase 28 includes a horizontal bearing surface 29 (FIG. 6) upon which base plate 60 of orbiting scroll 26 is bearingly supported, and a plurality of leg members 31 disposed in spaced relation about the outer periphery of crankcase 28. Fasteners (not shown) extend into the lower ends of leg members 31 to connect stator 32 to crankcase 28. Crankcase 28 includes wall 33 defined between adjacent pairs of leg members 31 on either side of suction port 40, which wall 31 directly faces, and is in fluid communications with, suction port 40, with wall 33 and leg members 31 together forming a channel 37. Additionally, wall 33 of crankcase 28 further includes an impingement section 35 extending upwardly from wall 33 between leg members 31 which also directly faces, and is in fluid communication with, suction port 40. Impingement section 35 extends axially upwardly between legs 31 a greater distance than bearing surface 29 and the remainder of wall 33 of crankcase 28.

Referring to FIG. 4, operation of baffle member 80 in scroll compressor 10 will now be described. When scroll compressor 10 is operating, working fluid at suction pressure enters suction chamber 38 via suction port 40 along the general direction of the arrows through suctions ports 40 in FIGS. 4 and 5 and initially impinges upon crankcase 28. In particular, working fluid at suction pressure enters suction port 40 and impinges on wall 33 and on impingement section 35 of crankcase 28 between an adjacent pair of leg members 31 of crankcase 28. Impingement section 35 blocks working fluid from passing into the space between crankcase 28 and orbiting scroll 26. As may be seen from FIGS. 4-6, leg members 31, wall 33, and impingement section 35 direct and channel the working fluid such that a portion of the working fluid flows downwardly within suction chamber 38, as designated by arrow D in FIGS. 4 and 5, and another portion of the working fluid flows upwardly within suction chamber 38, as designated by arrow E in FIGS. 4 and 5. Lubricant entrained within the working fluid is separated from the working when the working fluid impinges upon crankcase 28, and the lubricant falls downwardly by gravity into an oil sump within the lower portion of compressor 10.

The portion of the working fluid which flows upwardly within suction chamber 38 in the direction of arrow E enters first open end 88 of baffle member 80 and is directed by front wall 82, curved top wall 84, and side walls 86 of baffle member 80 through second open end 90 of baffle member 80 and into suction inlet 66 of fixed scroll 24 along the direction of arrows F in FIG. 4, and thence into the working pockets which are defined between wraps 50 and 62 of fixed and orbiting scrolls 24 and 26, respectively. Thereafter, the working fluid is compressed within working pockets in a known manner, and is discharged through discharge outlet 68 of fixed scroll 24 and discharge valve assembly 70 along arrow G of FIG. 4 into discharge chamber 42 at discharge pressure.

In the foregoing manner, baffle member 80 operates to direct a portion of the working fluid which enters housing 12 of scroll compressor 10 directly into suction inlet 66 of fixed scroll 24, thereby reducing turbulence in the flow of the working fluid within the upper portion of suction chamber 38 to increase the operating efficiency of compressor 10.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor, comprising:

a housing having a suction port;

a motor-compressor unit disposed within said housing, including a crankcase and a stator, rotor, and drive shaft assembly, said drive shaft rotatably supported by said crankcase, said crankcase including a wall directly facing, and in direct fluid flow communication with, said suction port with no structure disposed between said wall and said suction port, such that fluid entering said housing through said suction port initially impinges on said wall upon entry into said housing through said suction port;

a first scroll member fixed with respect to said housing and defining perpendicular axial and radial directions, said first scroll member comprising:

a base plate;

a first wrap extending from said base plate; and an outer wall having a suction inlet facing substantially in the radial direction, said suction inlet including a baffle member, said baffle member including a first open end and a second open end, said first open end facing in the axial direction toward said suction port and said second open end facing in the radial direction toward said suction inlet of said first scroll member; and a second scroll member coupled to said drive shaft for orbital movement, said second scroll member including a second wrap intermeshed with said first wrap.

2. The compressor of claim 1, wherein said baffle member is formed as a separate component from said first scroll member, said baffle member attached to said first scroll member.

3. The compressor of claim 1, wherein each of said first scroll member and said baffle member include a lower end and an upper end with respect to said axial direction, said lower and upper ends of said baffle member not extending beyond said lower and upper ends of said first scroll member, respectively.

4. The compressor of claim 1, wherein said baffle member is disposed proximate said suction inlet port of said housing and is spaced from said suction port in the axial direction.

5. The compressor of claim 1, wherein said baffle member is made of a plastic material.

6. The compressor of claim 1, further comprising:

a discharge port in said housing; and a separator plate attached to said first scroll member and said housing, said separator plate dividing an interior of said housing into a suction chamber in fluid communication with said suction port and a discharge chamber in fluid communication with said discharge port.

7. The compressor of claim 1, wherein said motor-compressor unit is disposed within said suction chamber.

8. A compressor, comprising:

a housing having a suction port and a discharge port;

a motor-compressor unit disposed within said housing, including a crankcase and a stator, rotor, and drive shaft assembly, said drive shaft rotatably supported by said crankcase;

a first scroll member fixed with respect to said housing and defining perpendicular axial and radial directions and having a lower end with respect to said axial direction, said first scroll member comprising:

a base plate;

a first wrap extending from said base plate;

an outer wall having a suction inlet facing substantially in the radial direction; and a baffle member attached to said first scroll and including an open end facing substantially in the axial direction toward said suction port, said baffle member having a vertical wall, said wall having a lowermost end which does not extend beyond a lowermost end of said first scroll member; and a second scroll member coupled to said drive shaft for orbital movement, said second scroll member including a second wrap intermeshed with said first wrap.

9. The compressor of claim 8, wherein said first scroll member and said baffle member each include an upper end with respect to said axial direction, said upper end of said baffle member not extending beyond said upper end of said first scroll member.

10. The compressor of claim 8, wherein said crankcase includes a wall directly facing, and in fluid communication with, said suction port.

11. The compressor of claim 8, wherein at least a portion of said baffle member is disposed within said suction inlet, and is secured to said first scroll member by at least one fastener.

12. The compressor of claim 8, further comprising a separator plate attached to said first scroll member and said housing, said separator plate dividing an interior of said housing into a suction chamber in fluid communication with said suction port and a discharge chamber in fluid communication with said discharge port.

13. The compressor of claim 11, wherein said motor-compressor unit is disposed within said suction chamber.

14. The compressor of claim 8, wherein said baffle is made of a plastic material.

15. A compressor, comprising:

a housing having a suction port and a discharge port;

a motor-compressor unit disposed within said housing and operable to receive a working fluid at a suction pressure from said suction port, compress the working fluid, and discharge the working fluid at a discharge pressure through said discharge port, said motor-compressor unit comprising:

a crankcase including a pair of leg members and at least one wall disposed between said leg members and directly facing said suction port such that working fluid entering said suction port impinges directly on said crankcase wall, and said wall and said leg members direct and channel at least a portion of said working fluid in substantially opposite directions within said housing;

a stator, rotor, and drive shaft assembly, said drive shaft rotatably supported by said crankcase;

a first scroll member fixed with respect to said housing and defining perpendicular axial and radial directions, said first scroll member including a base plate, a first wrap extending from said base plate, and an outer wall having a suction inlet facing substantially in the radial direction;

a second scroll member coupled to said drive shaft for orbital movement, said second scroll member including a second wrap intermeshed with said first wrap;

a baffle member attached to said first scroll and including a first end facing substantially in the axial direction toward said suction port and a second end facing substantially in the radial direction toward said suction inlet, whereby at least a portion of the working fluid which enters said suction port and impinges directly on said crankcase wall is directed by said baffle member into said suction inlet.

16. The compressor of claim 15, wherein said crankcase includes at least a pair of leg members, and an impingement section extending between said leg members.

17. The compressor of claim 15, wherein each of said first scroll member and said baffle member includes a lower end and an upper end with respect to said axial direction, said lower and said upper ends of said baffle member not extending beyond said lower and said upper ends of said first scroll member, respectively.

18. The compressor of claim 15, wherein said second end of said baffle member is disposed within said suction inlet and is secured to said first scroll member by at least one fastener.

19. The compressor of claim 15, further comprising a separator plate attached to said first scroll member and said housing, said separator plate dividing an interior of said housing into a suction chamber in fluid communication with said suction port and a discharge chamber in fluid communication with said discharge port.

20. The compressor of claim 19, wherein said motor-compressor unit is disposed within said suction chamber.

21. The compressor of claim 15, wherein said baffle is made of a plastic material.

22. A compressor, comprising:

a housing having a suction port;

a motor-compressor unit disposed within said housing, including a crankcase and a stator, rotor, and drive shaft assembly, said drive shaft rotatably supported by said crankcase, said crankcase including a wall directly facing, and in direct fluid flow communication with, said suction port whereby fluid entering said housing through said suction port initially impinges on said wall;

a first scroll member fixed with respect to said housing and defining perpendicular axial and radial directions, said first scroll member comprising:

a base plate;

a first wrap extending from said base plate; and an outer wall having a suction inlet facing substantially in the radial direction, said suction inlet including a baffle member; and a second scroll member coupled to said drive shaft for orbital movement, said second scroll member including a second wrap intermeshed with said first wrap; and wherein said crankcase further comprises:

a horizontal bearing surface; and an impingement section extending upwardly from said wall a beyond said horizontal bearing surface, said impingement section directly facing said suction port such that working fluid entering said suction port impinges directly on said impingement section.

23. The compressor of claim 15, wherein said crankcase further comprises:

a horizontal bearing surface; and an impingement section extending upwardly from said wall a greater distance than said horizontal bearing surface.

* * * * *